US007124604B2

(12) United States Patent
Taylor et al.

(10) Patent No.: US 7,124,604 B2
(45) Date of Patent: Oct. 24, 2006

(54) COLD BEVERAGE SERVER METHOD AND APPARATUS

(76) Inventors: Andrea Renee Taylor, 3216 Oakley Ct., Evans, CO (US) 80620; Mark Alan Taylor, 3216 Oakley Ct., Evans, CO (US) 80620

( * ) Notice: Subject to any disclaimer, the term of this patent is extended or adjusted under 35 U.S.C. 154(b) by 235 days.

(21) Appl. No.: 10/942,963

(22) Filed: Sep. 17, 2004

(65) Prior Publication Data

US 2006/0059944 A1 Mar. 23, 2006

(51) Int. Cl.
*F25D 3/08* (2006.01)

(52) U.S. Cl. ..... 62/457.4; 62/530

(58) Field of Classification Search ..... 62/457.1, 62/457.2, 457.3, 457.4, 530
See application file for complete search history.

(56) References Cited

U.S. PATENT DOCUMENTS

| | | | | |
|---|---|---|---|---|
| 4,745,776 | A * | 5/1988 | Clark | 62/457.4 |
| 4,910,977 | A | 3/1990 | Hilton | |
| 4,989,415 | A * | 2/1991 | Lombness | 62/372 |
| 5,212,963 | A * | 5/1993 | McGinnis | 62/457.4 |
| 6,786,062 | B1 | 9/2004 | Greenberg | |

* cited by examiner

*Primary Examiner*—Melvin Jones
(74) *Attorney, Agent, or Firm*—Bradford Kile; Kile Goekjian Reed & McManus PLLC

(57) ABSTRACT

A method and apparatus for serving a cold drink including a base with a rim, a cooling puck having at least an upper surface to conform to a lower surface of the base of a serving container and a flat base surface to fit within said rim of the base. The cooling puck is preferably composed of a plastic shell and contains a fluid that is liquid at room temperature but can be frozen in a conventional freezer compartment of a refrigerator.

17 Claims, 4 Drawing Sheets

COLD BEVERAGE SERVER METHOD AND APPARATUS

BACKGROUND OF THE INVENTION

Field of the Invention

The present invention relates to the maintenance of a beverage in a cold or cool state during consumption. More specifically, this invention relates to an enhanced method and apparatus for keeping at least the bottom portion of a served beverage in a cooled condition while it is being consumed.

Prior attempts to keep a beverage, such as beer, soda, juice, water, milk, etc. in a cold state after its removal from a refrigerator or ice filled cooler have included a variety of passive insulation holders or carriers. These devices often take the form of a closed end cylinder of closed cell rubber or expanded, closed cell plastic materials that are designed to slide around a conventional beverage can or bottle. Sleeves of this type are often descriptively referred to as "huggies." Such holders operably reduce the rate of ambient heat absorption through the side walls of a typical aluminum beverage can or glass bottle.

Huggies are inexpensive and quite functional, to a degree, but are limited to merely isolating the beverage container from a warm ambient environment and are not capable of providing any cooling function during consumption. If a can of beer or soda is consumed quickly—slam dunked—after being served such isolation sleeves tend to keep the beverage suitably cold. If, however, the beverage is consumed at a more leisurely rate the beverage will absorb ambient heat until the temperature of the environment is reached. The last third of a bottle or can of beer does not taste nearly as good in a warm condition as the refrigerated first sip. It would therefore be highly desirable to provide an inexpensive method and apparatus for serving bottles and cans of beverage that actually provide a degree of cooling during consumption.

Ice can be added to sodas served in a glass, however, adding ice to beer entails a diluting aspect that is not desirable for most beer consumption. Moreover, some consumers even find watered down soda undesirable and, of course, ice can not be added to a beverage served in a bottle or can. Still further, adding ice into a consumable beverage adds the possibility of contamination of the beverage fluid. Accordingly, it would be desirable to provide a method and apparatus for maintaining a beverage in a cold state for an extended period of time, during consumption, without relying on the addition of ice or any other object that must be placed within the beverage to be consumed.

At a bar, beer that is drawn on tap is often served in a frosted glass. Soda fountains frequently serve frosted drinks in this manner as well. This is accomplished by washing the glass and then putting the glass in a freezer without drying. The glass then becomes enrobed in a sheen of ice in the freezer. Some suggest that beer or soda served in this manner tastes great. In any event, most would agree that the first cold sip just seems more appealing than the last third of the glass when the ice has melted and the beer or soda has warmed. It would therefore be desirable to devise a novel, inexpensive, serving method and apparatus for enhancing a consumer's satisfaction with the bottom third of a glass, bottle or can of a consumable beverage.

The foregoing limitations and desires for serving a cold beverage are not intended to be exhaustive but rather are among many which may tend to reduce the enjoyment in consuming cold beverages in the past. Other noteworthy limitations may also exist; however, those presented above should be sufficient to demonstrate that methods and apparatus of serving cold beverages in the past will admit to worthwhile improvement.

OBJECTS OF THE INVENTION

It is, therefore, a general object of the invention to provide an efficient and inexpensive method and apparatus for serving a cold beverage for consumption.

It is another general object of the invention to provide a method and apparatus that will aid in maintaining a cold temperature of a served beverage in a relative warm ambient environment during consumption.

It is a further object of the invention to serve a consumable beverage that requires maintaining a cold temperature because of its perishable nature, such as for example, milk.

It is a related object of the invention to provide a novel method and apparatus for serving a cold beverage without using ice cubes or placing any other objects into direct contact with the beverage that might dilute or contaminate the beverage.

It is still another object of the invention to provide a novel method and apparatus for enhanced cooling the bottom portion of a beverage even as it is being consumed in a warm ambient environment.

It is yet another object of the invention to provide an enhanced method and system for serving and maintaining beverages in a cold condition following serving.

SUMMARY OF THE INVENTION

To achieve at least some of the foregoing objects, the subject invention comprises a base or holder that operably carries a frozen gel puck. The base can take the form of a generally square coaster made from cardboard or polystyrene foam or other plastic material with a central circular rim or upwardly extending side wall. A circular puck shell is operable to be positioned within the circular rim and is fashioned from a tough plastic outer shell having generally cylindrical side walls and an arcuate top or crown. In one embodiment the crown is supplemented with an annular rim to further maintain a can of beverage in a cold condition. The interior of the puck is filled with a nontoxic jell such as propylene-glycol that is fluid at room temperature of about 72° Fahrenheit but is capable of being frozen in a conventional freezer department of a refrigerator.

In operation a consumer places the puck into a freezer until a beverage is ready to be served. The puck is designed to have a convex, arcuate dome that is dimensionally compatible with a concave, arcuate recess in the bottom of a glass bottle or can of beverage to be served. The frozen puck is then placed within the base with the flat circular bottom portion within the circular rim of the base with the dome shape extending upwardly.

The side walls of the base can be variable but extend at least to a height sufficient to engage the side walls of the puck and preferably extend upwardly for at least a portion of the height a glass, bottle or can. The frozen puck, conforming with the base of the beverage container, keeps the container cold while the beverage is intermittently lifted out of the base. Alternatively, the base, puck and side walls of the base can be lifted with the can for consumption. Following consumption of the beverage the puck is placed back into a freezer for refreezing and reuse.

The subject invention finds useful application at a bar where beer is sold on tap from a glass, at a picnic where beer and sodas are served in a bottle or can, at home while watching television or dining and generally anywhere where cold beverages are being consumed.

THE DRAWINGS

Other objects and advantages of the present invention will become apparent from the following detailed description of preferred embodiments taken in conjunction with the accompanying drawings wherein.

DETAILED DESCRIPTION

Figure 1:
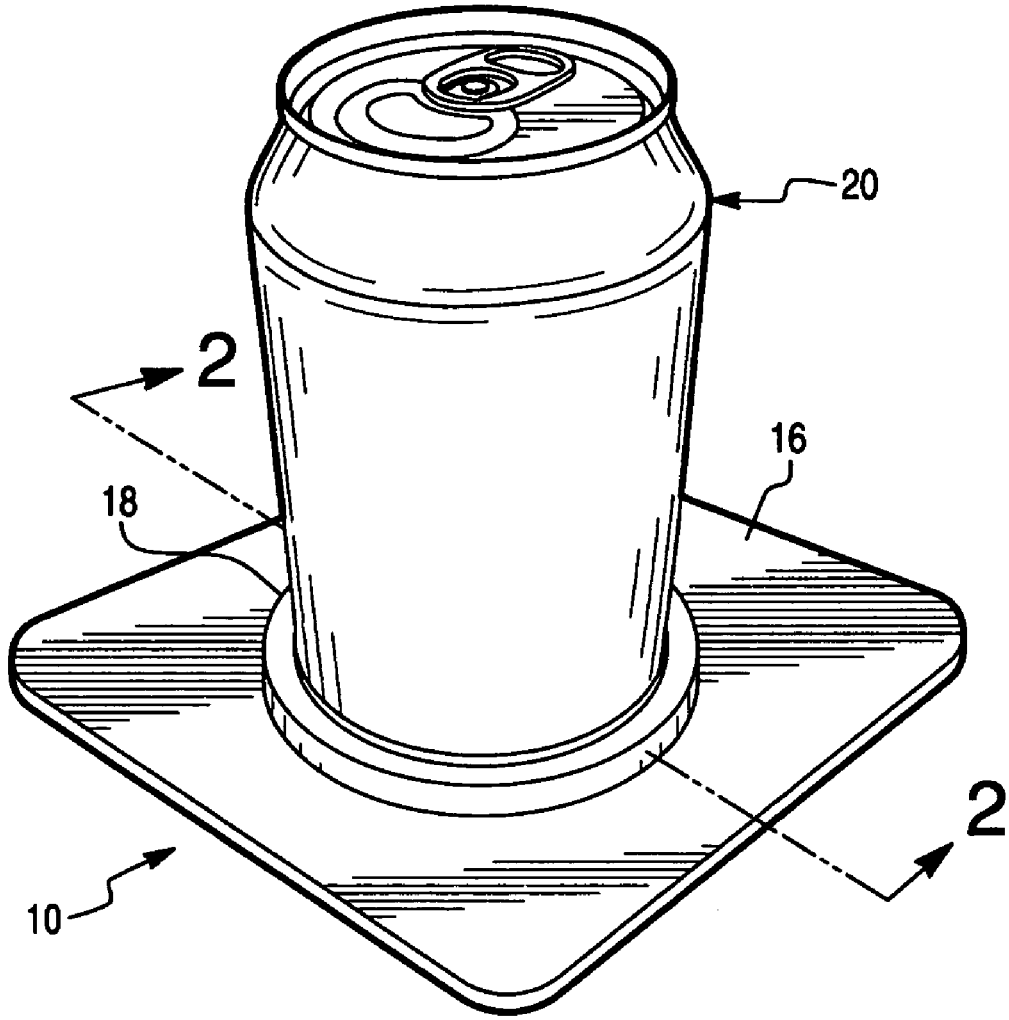
FIG. 1 is an axonometric view of a base and a can of beverage positioned on the cooling base in accordance with one embodiment of the subject invention.

Turning now to the drawings where like numerals designate like parts, FIG. 1 discloses an axonometric view of a cooling device 10 in accordance with one preferred embodiment of the invention.

Figure 2:
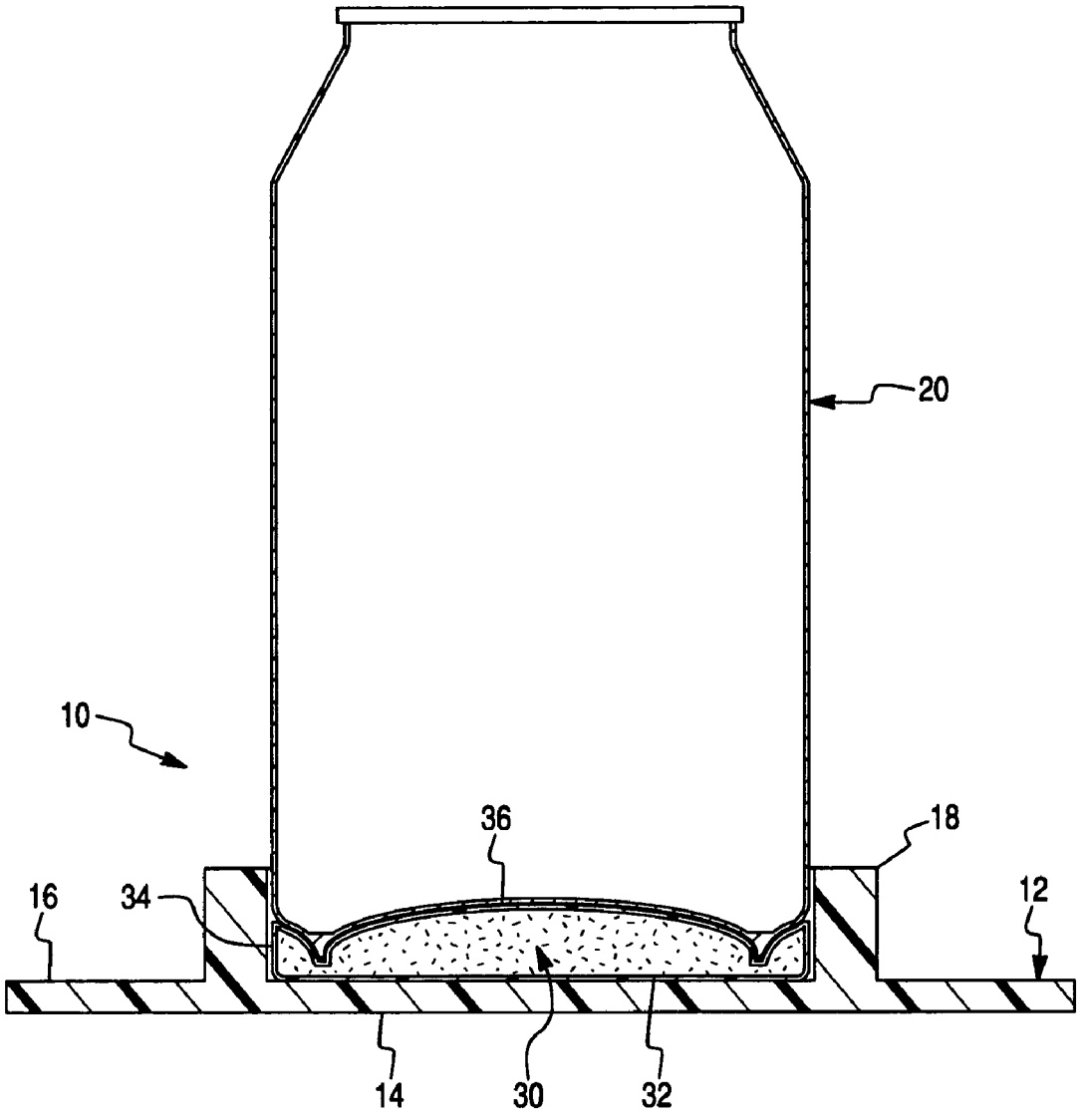
FIG. 2 is a cross-sectional view, taken along section line 2–2 in FIG. 1, and discloses the positioning of a puck between the base a the can of beverage.

The cooling system 10 includes a base 12 having a generally flat lower surface 14 and a parallel upper flat surface 16, note FIG. 2. The base comprises a generally square coaster with a central, peripheral rim 18. The shape of the rim can be any geometric configuration designed to conform to the outside surface of a container 20 to serve beverages. Generally, however, the rim will comprise a circular configuration in plan view to conform to a cylindrical aluminum can of beverage.

The rim 18 includes side walls that extend upwardly from the upper surface 16 of the base and operably engage the outer surface of a beverage container 20. The height of the side wall of the rim 18 can vary and in one preferred embodiment extends upwardly only high enough to engage the cylindrical side wall of the container 20 such as shown in FIG. 2. In this embodiment the base is functionally a coaster as well as part of a beverage cooling system.

A cooling disc or puck 30 is positioned within the rim 18. The puck 30 is formed with a plastic shell having a flat base 32, side walls 34 which generally conform to the interior surface of the rim 18 and an upper domed surface 36. The puck is filled with a liquid or gel that is a fluid at room temperature of 72 degrees or so but is capable of being frozen at 32 degrees Fahrenheit or so into a frozen solid. The specific material can vary and preferably the gel material will have a freezing point lower than 32 degrees provided that the interior fluid or gel is operable to be frozen by a conventional freezer department of a refrigerator and will also exhibit a high latent heat of absorption to transition from a frozen solid to a liquid state.

Figure 3:
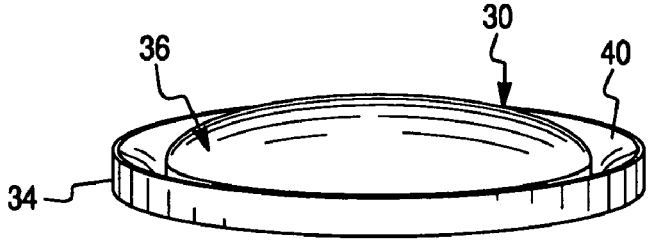
FIG. 3 is an axonometric view of a cooling puck, per se, in accordance with a preferred embodiment of the invention.
Figure 4:
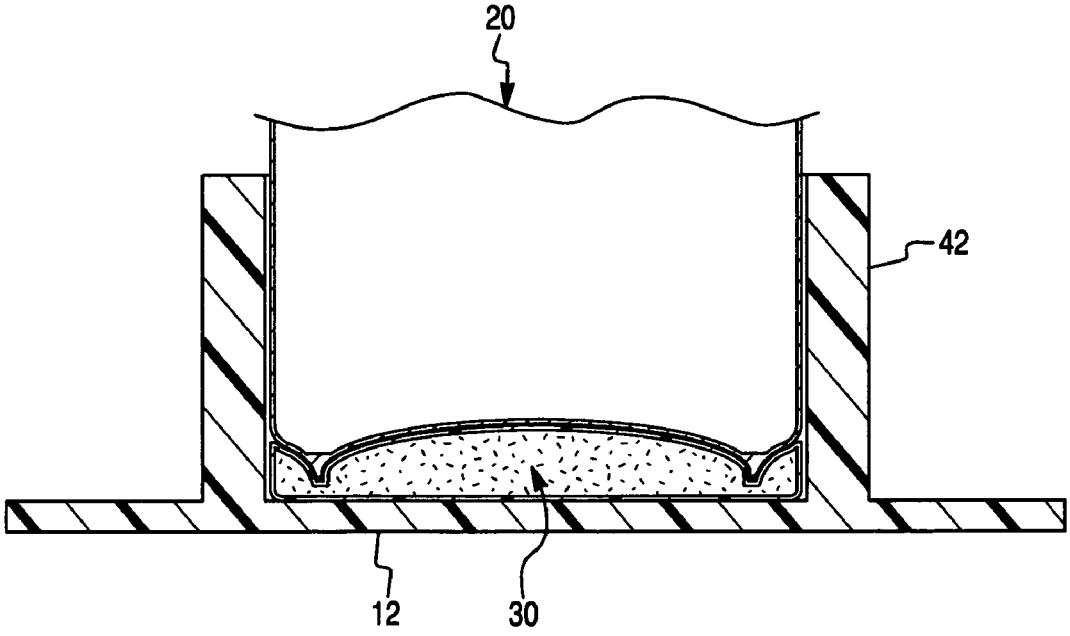
FIG. 4 is a partial cross-sectional view of another embodiment of a base and a cooling puck with a can of beverage.

Turning now to FIGS. 3 and 4 it will be seen that in a preferred embodiment of a cooling puck, per se, is shown. In this embodiment a can of beverage is to be served, and maintained cold while being consumed, the puck 30 is fashioned with a circular outwardly sloping rim 40. The rim 40 is designed to conform to an inwardly sloping surface of an aluminum beverage can. The height of the dome 36, at its center, is greater than the height of the rim 40. In this manner the puck operably engages more of the surface of the aluminum can for direct, conduction, heat transfer. In addition, this rim 40 provides a lateral stabilizing function for the can when the cooling puck 30 is used to serve a can of beverage without using a base member 12. In order to facilitate retention of the puck 30 onto the bottom of a can of beverage the outer diameter of the dome 36, plus tolerance, is slightly greater than the inner diameter of the concave recess of a can of beverage to provide a mild interference fit. Accordingly, in operation a user will merely obtain a frozen puck 30 from a freezer and push it onto the bottom of a can of beverage. Because of the interference fit the puck 30 will self-adhere to the bottom of the can and consumption of the beverage may proceed in a usual manner with a consumer holding the side of the can and with the frozen puck 30 cooling the fluid within the can. The flat bottom surface 32 of the puck enables the beverage to be placed on a conventional flat coaster or other horizontal surface while the beverage is not being consumed.

FIG. 4 is a modification of the embodiment disclosed in FIG. 2 and depicts an extension of the rim portion 42 upwardly from the base 12 along the lateral surface of the beverage container 20. This enables the base to even better retain and insulate a beverage container such a can of beverage 20.

Figure 5:
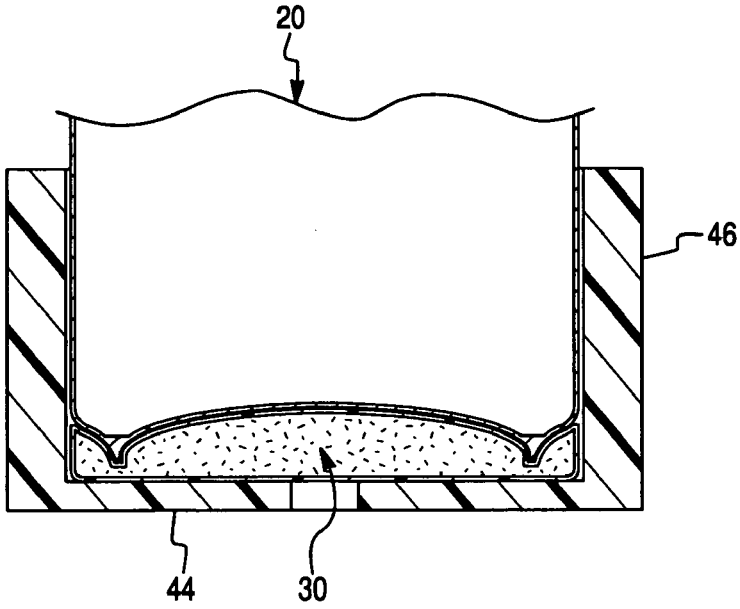
FIG. 5 is a partial cross-sectional view of another embodiment of a base and a cooling puck with a can of beverage.

FIG. 5, note sheet 4 of the drawings, is yet another variation of the invention where a base 44 extends only outwardly to the periphery of a rim 46 and accommodates a cooling puck 48 with a configuration as discussed above. In this embodiment the rim 46 extends upwardly and may even extend along the height of a can of beverage for extra insulation.

Figure 6:
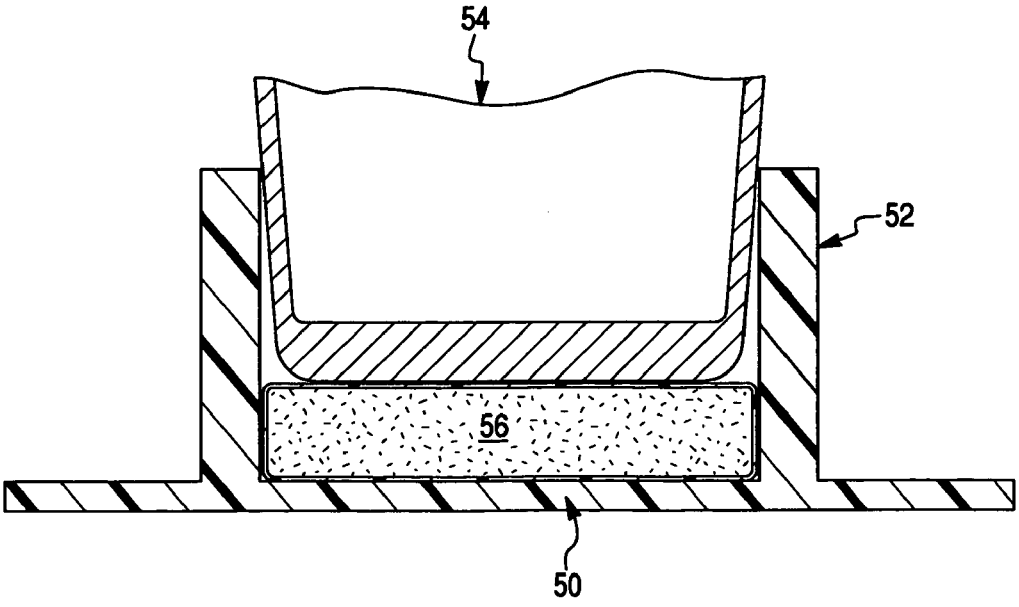
FIG. 6 is a partial cross-sectional view of yet another embodiment of the invention useful with a serving glass.

FIG. 6 is another embodiment of the invention and in this case a base 50 is provided is the form of a coaster. The rim 52 extends upwardly along a container side wall 54 which may be a glass with a flat bottom. A cooling puck 56 is positioned within the base, as shown, and comprised a circular disc shell that is filled with a fluid to be frozen as discussed above. In this embodiment however, the puck has a flat upper surface to accommodate the flat bottom surface of the glass. The frozen puck 56 is kept cold and frozen by the insulation provided by the surrounding base 50 and thus the puck serves to impart cooling to the beverage within the glass as it is being consumed.

Several embodiment of the invention have been disclosed. In the various embodiments the base is preferably made from a cellulose material or foam rubber of polystyrene. All of these materials provide good insulation for the frozen puck and a lower portion of a container of beverage during consumption.

In operation a server of a beverage secures a base and retrieves a frozen puck element from a freezer. The puck is placed in the bottom of the base and then a can of beverage is placed within the rim of the base. Because the puck is frozen it actually withdraws heat from the beverage as it is being consumed and as opposed to the beverage becoming warmer is becomes cooler. Following consumption the puck is retrieved and place back into the freezer to be reused at a later time in a refrozen condition.

SUMMARY OF MAJOR ADVANTAGES OF THE INVENTION

After reading and understanding the foregoing description of preferred embodiments of the invention, in conjunction with the illustrative drawings, it will be appreciated that there are several advantages to the present invention.

One significant advantage is that a beverage can be consumed and actually get colder as it is being consumed. Another significant advantage is the ability to prevent the last third of a can of beverage from getting warm if consumption is at a leisurely pace.

Another advantage is the ability to reuse the invention to serve a cold beverage a number of times very inexpensively. The cooling puck 30 can be used independently of the base 12 and fit snuggly onto the bottom of a can of beverage by a mild interference fit.

Still further the subject will keep a beverage cold longer for consumption of beverages that might spoil if it become too warm—such as milk.

The subject invention provides a dual function of being a coaster or beverage carrier and providing a cooling function during consumption as opposed to conventional warming.

The subject invention provides its cooling function and can be reused and does not require anything to be added to the beverage being consumed.

In describing the invention, reference has been made to preferred embodiments and illustrative advantages of the invention. Those skilled in the art, however, and familiar with the instant disclosure of the invention, may recognize additions, deletions, modifications, substitutions and other changes which fall within the purview of the subject invention.

What is claimed is:

1. An apparatus for serving a beverage in a cold condition, said apparatus comprising:

a base having a lower, generally flat, surface and an upper, generally flat surface, with a retaining rim;

a cooling puck shell having a flat base and a side wall operable to fit within and generally conform with the interior of said retaining rim of said base, said puck shell having an arcuate upper surface operable to conform to a bottom concave surface of a beverage serving container;

a cooling fluid carried within said puck shell and being operable to be frozen for absorbing heat from fluid within a beverage container positioned upon said cooling puck within said base rim; and wherein said rim is circular and extends upwardly in the shape of a cylinder to at least partially embrace a peripheral side wall of a container of beverage to be consumed.

2. An apparatus for serving a beverage in a cold condition as defined in claim 1 wherein: said rim is circular and the side wall of said cooling puck is circular and dimensioned to generally conform with an interior surface of said rim.

3. An apparatus for serving a beverage in a cold condition as defined in claim 1 wherein:

said upper surface of said cooling puck comprises a convex dome operable to conform to a concave dome of the bottom of a beverage can and further having an upwardly extending peripheral rim operable to conform with a peripheral recess in the periphery of the bottom of the beverage can.

4. An apparatus for serving a cold beverage as defined in claim 3 wherein:

the height of the dome at its center point is greater than the height of the peripheral rim of said cooling puck.

5. An apparatus for serving a beverage in a cold condition as defined in claim 3 wherein:

said cooling puck shell is composed with plastic shell and is filled with a non-toxic propylene-glycol gel which is generally a fluid at room temperature and can be frozen in a conventional freezer of a refrigerator; and the diameter of the internal surface of said rim is an interference fit with respect to the exterior diameter of said cooling puck.

6. An apparatus for serving a beverage in a cold condition as defined in claim 3 wherein:

the diameter of the internal surface of said rim is a loose non-interference fit with respect to the exterior diameter of said cooling puck; and the height of said rim extends upward along the height of a can of said beverage.

7. An apparatus for serving a beverage in a cold condition as defined in claim 1 wherein:

said base is composed of cellulose.

8. An apparatus for serving a beverage in a cold condition as defined in claim 1 wherein:

said base is composed of polystyrene foam.

9. An apparatus for serving a beverage in a cold condition as defined in claim 1 wherein:

said base is composed of a rubber foam composition.

10. An apparatus for serving a beverage in a cold condition, said apparatus comprising:

a base having a lower, generally flat, surface and an upper, generally flat surface, with a retaining rim;

a cooling puck shell having a flat base and a side wall operable to fit within and generally conform with the interior of said retaining rim of said base, said puck shell having a generally flat upper surface operable to conform to the bottom surface of a beverage serving container; and a cooling fluid carried within said puck shell and being operable to be frozen for absorbing heat from fluid within a beverage container positioned upon said cooling puck within said base rim.

11. An apparatus for serving a beverage in a cold condition as defined in claim 10 wherein:

said rim is circular and extends upwardly in the shape of a cylinder to substantially embrace a peripheral side wall of a container of a can of beverage to be consumed and said rim being composed of an insulation material formed from foam rubber.

12. An apparatus for serving a beverage in a cold condition, said apparatus comprising:

a cooling puck shell having a flat base and a side wall extending from the flat base the puck further having an arcuate upper surface operable to conform to a bottom concave surface of a beverage serving container;

the diameter of said puck has a dimension greater than the interior diameter of a concave recess in the bottom of a beverage container; and a cooling fluid carried within said puck shell and being operable to be frozen for absorbing heat from fluid within the beverage container positioned upon said cooling puck.

13. An apparatus for serving a beverage in a cold condition as defined in claim 12 and further comprising:

a rim extending outwardly and upwardly from said arcuate upper surface to substantially embrace a peripheral side wail of a beverage container of a beverage to be consumed.

14. An apparatus for serving a beverage in a cold condition as defined in claim 13 and further comprising:

the height of the center of said dome being greater than the height of said rim extending outwardly and upwardly from said arcuate upper surface of said cooling puck.

15. An method for serving a cold beverage from a container, said method comprising the steps of: providing a base having a generally flat upper surface and a generally circular upstanding rim;

positioning a cooling puck comprising a shell having a flat generally circular base, generally cylindrical side walls and an arcuate convex dome and being filled with a fluid at room temperature and further being operable to be frozen by a conventional freezer department of a refrigerator; and positioning a cold beverage container within said circular upstanding rim wherein a concave surface of the base of the container conforms to the convex dome of said cooling puck for maintaining the container of cold beverage cold during consumption of the beverage.

16. An method for serving a cold beverage from a container as defined in claim 15 wherein, said method further comprising the steps of:

maintaining the cooling puck in a frozen state within a freezer and positioning the puck within the rim of said base just prior to serving a beverage with said base and cooling puck.

17. An method for serving a cold beverage from a container as defined in claim 15 wherein, said method further comprising the steps of:

insulating said cooling puck and beverage container from a warm ambient environment while said beverage is being consumed.

* * * * *